US011420437B2

(12) United States Patent
Meisinger

(10) Patent No.: US 11,420,437 B2
(45) Date of Patent: Aug. 23, 2022

(54) TWO-COMPONENT DRIP EDGE

(71) Applicant: FRESENIUS MEDICAL CARE DEUTSCHLAND GMBH, Bad Homburg (DE)

(72) Inventor: Sebastian Meisinger, Marpingen (DE)

(73) Assignee: FRESENIUS MEDICAL CARE DEUTSCHLAND GMBH, Bad Homburg (DE)

( * ) Notice: Subject to any disclaimer, the term of this patent is extended or adjusted under 35 U.S.C. 154(b) by 570 days.

(21) Appl. No.: 16/312,739

(22) PCT Filed: Jun. 19, 2017

(86) PCT No.: PCT/EP2017/064893
§ 371 (c)(1),
(2) Date: Dec. 21, 2018

(87) PCT Pub. No.: WO2017/220470
PCT Pub. Date: Dec. 28, 2017

(65) Prior Publication Data

US 2020/0307176 A1 Oct. 1, 2020

(30) Foreign Application Priority Data

Jun. 21, 2016 (DE) ..... 10 2016 007 574.0

(51) Int. Cl.
*B41F 31/20* (2006.01)
*B41F 31/26* (2006.01)

(52) U.S. Cl.
CPC ..... *B41F 31/20* (2013.01); *B41F 31/26* (2013.01)

(58) Field of Classification Search
CPC ..... B41F 31/20; B41F 31/26; B41F 31/00; B41F 31/02; B29C 2043/464
See application file for complete search history.

(56) References Cited

U.S. PATENT DOCUMENTS

| | | | | |
|---|---|---|---|---|
| 3,468,251 A | | 9/1969 | Brockmüller | |
| 5,216,953 A | * | 6/1993 | Hada | B41F 13/10 101/375 |
| 5,715,748 A | * | 2/1998 | Murakami | B41F 15/44 101/114 |

FOREIGN PATENT DOCUMENTS

| | | |
|---|---|---|
| DE | 1249885 | 9/1967 |
| DE | 19860334 | 6/2000 |
| EP | 0374482 | 6/1990 |
| EP | 0518614 | 12/1992 |

* cited by examiner

*Primary Examiner* — Leslie J Evanisko
*Assistant Examiner* — Leo T Hinze
(74) *Attorney, Agent, or Firm* — Jacobson Holman PLLC

(57) ABSTRACT

The invention relates to a device having a two-component drip edge. One side of the drip edge is formed by a material having an attractive behavior with respect to a liquid and the opposite side of the drip edge is formed from a material having a repulsive behavior with respect to the liquid. This design yields an improved drip effect.

15 Claims, 4 Drawing Sheets

TWO-COMPONENT DRIP EDGE

TECHNICAL FIELD

The invention relates to devices with which a controlled drip of liquids is to be guaranteed, as in the case of a pan roller in a printing machine.

BACKGROUND

Drip edges are known in the state of the art and are always used in practice whenever a liquid, which wets a surface that is disposed essentially perpendicular to the gravitational force is to be made to drip passively, i.e., driven by the gravitational force, at a certain location in the device in a controlled manner. This should prevent the surface, which is disposed behind the drip edge, from coming in contact with the liquid. Furthermore, the dripping liquid can be collected beneath the drip edge in a targeted manner.

Drip edges are usually mounted on surfaces, which are disposed mostly at a right angle to the direction of the gravitational force, for example, and which are wetted at least temporarily with a liquid which is to be made to drip from this surface in a controlled manner. Drip edges are usually V-shaped, i.e., form an acute-angle edge, having two flanks attached, wherein the tip and/or edge is aligned in the direction of the gravitational force. The liquid travels along the flank toward the edge of the drip edge. Since the liquid would have to move opposite the gravitational force after reaching the edge on the opposite flank, a drip forms on the edge and then falls off the drip edge.

Drip edges are used primarily for protection against water with stationary surfaces, for example, in construction engineering. Drip edges are not known for use with rotating systems, e.g., on printing machines with pan rollers, where other approaches are generally used. The reason for this is that a liquid film is usually created with rotating systems, because the liquid is entrained in the direction of rotation due to the surface tension and is thus drawn out. Therefore, no drip is formed initially. Only when a large enough bulge of liquid has been built up does it begin to drip, which is why traditional single-component drip edges are often inadequate. The problem can often occur that wetting of the surface also takes place beyond the tip of the drip edge, and the liquid thus also comes in contact with surfaces that should be protected from the liquid. In the case of printing machines, the excess ink can then spread from the pan roller or the transfer roller into the bearings in the printing machine, necessitating frequent maintenance.

For this reason, wipers and/or scrapers, which act directly on the end faces of the rollers and return the excess paint to the immersion pan, are generally used instead of drip edges on pan rollers. These scrapers have the disadvantage that they necessitate very complex constructions because contact between the scraper and the roller must be ensured and the scrapers are also very high maintenance. Furthermore, abrasion dust or particles may enter the ink pan due to wear on the scrapers, most of which are made of soft plastic. Pan rollers with scrapers are described in DE 19860334 or DE 1249885, for example.

The object of the invention is to provide an improved drip edge, which can also be used in rotating systems, for example.

SUMMARY OF THE INVENTION

According to the teaching of the present invention, this object is achieved by a device according to the following description, a roller according to the following description, and use of a device having a two-component drip edge according to the following description as well as by a printing machine according to the following description.

The device (I) of the invention is for controlled diversion of liquids from a surface that can be wetted with a liquid and comprises the surface (17) that can be wetted with liquid and a two-component drip edge attached to the surface, formed by an edge (18) which is aligned in the direction of the gravitational force and having a first flank (19) and a second flank (20) leading away from there, characterized in that the first flank (19) is in connected to the surface (17) that can be wetted with liquid and has a higher surface tension than the second flank (20). The device (II) of the invention is for controlled diversion of liquids from a rotationally symmetrical surface that can be wetted with liquid, comprising the rotationally symmetrical surface (1), preferably designed in the form of a cylinder, and a two-component drip edge connected to the surface and formed by an edge (2), which is disposed concentrically with the rotationally symmetrical surface (1) and is directed outward, and comprising a first flank (3) and a second flank (4) leading away from the drip edge, wherein the first flank (3) is connected to the surface that can be wetted with liquid and has a higher surface tension than the second flank (4). According to each of the device (I) of the invention and the device (II) of the invention: preferably the surface tension of the liquid is less than or approximately the same as the surface tension of the first flank (3, 19) and is greater than the surface tension of the second flank (4, 20); preferably the first flank (3, 19) is made of iron, polyamide, polyethylene terephthalate, polymethyl methacrylate, polyethylene, polyvinyl chloride, polyoxymethylene, polystyrene or steel and the second flank (4, 20) is made of polypropylene, paraffin wax, epoxy resin or Teflon® (polytetrafluoroethylene), and more preferably the first flank (3, 19) is made of steel and the second flank (4, 20) is made of Teflon® (polytetrafluoroethylene); preferably the two flanks (3, 19, 4, 20) form an angle between 20° and 120°; and preferably the two-component drip edge has a height of 4-8 mm, more preferably 5 mm.

The roller of the invention is for transferring a liquid and comprises a transfer cylinder (6) which is wetted with liquid during use, and two connecting pieces (7) for fastening the roller in a bearing (11), characterized in that the connecting pieces each have at least one two-component drip edge connected to the connecting piece for controlled dripping of the liquid to be transferred and formed by an edge (2), which is disposed concentrically with the transfer cylinder and is directed outward, and comprising a first flank (3) and a second flank (4) leading away from the drip edge, wherein the second flank (4) of the drip edge faces the bearing (11), and wherein the first flank (3) faces the pan roller and is made of material having a higher surface tension than the second flank (4): preferably wherein the surface tension of the liquid is less than or approximately the same as the surface tension of the first flank (3, 19) and is greater than the surface tension of the second flank (4, 20); preferably wherein the first flank (3, 19) is made of iron, polyamide, polyethylene terephthalate, polymethyl methacrylate, polyethylene, polyvinyl chloride, polyoxymethylene, polystyrene or steel, and wherein the second flank (4, 20) is made of polypropylene, paraffin wax, epoxy resin, or Teflon® (polytetrafluoroethylene), and more preferably wherein the first flank (3, 19) is made of steel and the second flank (4, 20) is made of Teflon® (polytetrafluoroethylene); preferably wherein the two flanks (3, 19, 4, 20) form an angle between 20° and 120°; preferably wherein at least one additional single component pre-drip edge (8, 9) is disposed between the two-component drip edge and the transfer cylinder; preferably wherein the pre-drip edge (8, 9) has a height of 4-8 mm, more preferably 5 mm; preferably wherein the pre-drip edge (8, 9) forms an angle of 20-80°; and preferably wherein the roller is a pan roller (15) of a printing machine (16).

In agreement with the present teaching, a device having a surface, which can be wetted by a liquid and which has a two-component drip edge is disclosed in accordance with the present teaching. The two-component drip edge is formed by a V-shaped protrusion on the surface with an edge aligned in the direction of the gravitational force and two flanks leading away from it. The two flanks are each made of different materials. The first flank, which is aligned with the surface wetted by the liquid, may then have an attractive behavior with respect to the liquid, while the second flank may have a repulsive behavior with respect to the liquid. "Attractive" means good wettability, while repulsive is defined as more difficult to wet. The first flank of the two-component drip edge can be wetted better with the liquid than the second flank.

The wettability of a surface with a certain liquid depends on the surface tensions of the substances involved, i.e., the materials of the flanks and the liquid. It is true in general that a material with a higher surface tension or a surface tension approximately equal to that of the liquid can be wetted better than a material having a lower surface tension than the liquid. Materials whose surface tension is greater than or equal to that of the liquid have an attractive behavior with respect to the liquid and can be considered to be readily wettable. Materials whose surface tension is lower than that of the liquid have a repulsive behavior with respect to the liquid and can be considered to be not readily wettable.

The surface tension of the liquid should therefore be less than or approximately the same as the surface tension of the first flank and greater than the surface tension of the second flank.

Those skilled in the art are familiar with methods of determining wettability, such as contact angle analyses, for example.

The material of the first flank thus has a higher surface tension than the material of which the second flank is formed. Since a drip edge is used as protection with respect to unwanted liquid contact, the two-component drip edge is disposed on the surface in such a way the first flank, which is more readily wettable, is aligned toward the surface wetted with liquid, while the second flank, which is less readily wettable, is disposed on the opposite side, where the liquid contact should be prevented.

The border between the two materials runs along the edge of the drip edge. The edge is preferably designed in a straight line. The surfaces of the flanks may also be designed to be planar. However, the surfaces of the flanks may also be designed with a curvature.

If the surface if wetted with liquid, this liquid will first spread out to the tip, i.e., the edge, of the drip edge. A droplet is formed at the edge, driven by the gravitational force. In addition to the gravitational force, the formation of a droplet here is also promoted by the change in material along the edge of the drip edge because the material of which the second flank of the drip edge is formed has a lower surface tension and thus has a repulsive behavior with respect to the liquid.

The device according to the disclosure may also be designed in the form of a rotationally symmetrical body, in which the two-component drip edge is disposed in a circular pattern around the rotationally symmetrical body, for example, a cylinder, and is directed outward. While the cylinder is rotating, the two-component design of the drip edge ensures a controlled dripping of the liquid.

The device according to the invention may also be designed as materials of which the first flank of the two-component drip edge is formed, i.e., materials having an attractive behavior with respect to the wetting liquid, i.e., with a higher surface tension, such as iron, polyamide, polyethylene terephthalate, polymethyl methacrylate, polyethylene, polyvinyl chloride, polyoxymethylene, polystyrene or steel, for example.

The device according to the invention may contain as materials of which the second flank of the two-component drip edge is formed, i.e., materials having a repulsive behavior with respect to the wetting liquid, i.e., with a lower surface tension, for example, polypropylene, paraffin wax, epoxy resin or Teflon® (polytetrafluoroethylene).

In one embodiment, the two-component drip edge may be formed with a first flank made of steel and a second flank made of Teflon®.

In one embodiment, the two-component drip edge may be formed with a first flank made of steel and a second flank made of Teflon® (polytetrafluoroethylene).

The flanks of the two-component drip edge may form an angle between 20° and 120°, preferably an angle between 20° and 60°. The angle formed by the flanks with the surface may be asymmetrical. It is advantageous in particular if the second flank forms a small angle to the gravitational force, so that the liquid can rise as little as possible. The more acute the angle, the more effective is the drip action.

The height of the drip edge, i.e., the distance of the edge of the drip edge from the surface, depends on the dimensions of the surface. The drip edge may have a height of 4-20 mm, for example.

The width of the drip edge on the surface is obtained from the angle of the edges and the height of the drip edge. If the drip edge has a height of 4-20 mm and the angle is between 20° and 120°, the width may be 3-20 mm, for example.

In one embodiment, a roller is provided for transferring liquids with a drip edge according to the invention. For example, such rollers are used in printing machines, in which ink is transferred from an ink pan through a pan roller onto a receiving roller, which then in turn prints the ink on the object to be printed.

The roller according to the invention consists of a transfer cylinder, which is provided with connecting pieces on the two longitudinal ends. The transfer cylinder is partially immersed in a liquid, such as ink, for example, during operation, or it picks up the liquid from another roller. The transfer cylinder has a relatively large diameter. In any case, the diameter must be larger than that of the connecting pieces, so that these are not immersed in the liquid bath. For example, it may have a diameter of 8-50 cm, preferably between 10 and 25 cm.

The connecting pieces should not be immersed in the liquid or come in contact with the roller that supplies liquid. Therefore, they must have a smaller diameter than that of the transfer cylinder. They are used for fastening the transfer cylinder in the bearing and for connection of the drive of a rotary motor of a printing machine, for example, which causes the transfer cylinder to rotate. The connecting pieces must have a diameter, which ensures mechanical stability with respect to sagging or breaking of the roller. The diameter of the connecting pieces may be between 4 cm and 12 cm, for example.

The connecting pieces of the roller according to the disclosure each have at least one two-component drip edge, which is disposed in a circular pattern around the connecting piece. The two-component drip edge is disposed on the connecting piece in such a way that the flank made of the material having the attractive property, i.e., the material having the higher surface tension, is disposed in the direction of the transfer cylinder, and the flank made of the material having the repulsive property, i.e., having the lower surface tension, is disposed in the direction of the ends of the rollers, so that spreading of the liquid, for example, the ink, into the bearings of the printing machine is prevented.

The flanks of the two-component drip edge may form an angle between 20° and 120°. The first flank may be designed to be shallower than the second flank.

The height of the drip edge, i.e., the distance of the edge of the drip edge from the surface, depends on the dimensions of the surface. The drip edge may have a height of 4-20 mm, for example.

The width of the drip edge on the surface is obtained from the angle of the edges and from the height of the drip edge, which may amount to 3-30 mm, for example.

The invention also relates to the use of a device having a two-component drip edge according to the instant description for producing a low-maintenance transfer roller for a printing machine.

The invention also relates to a printing machine having a roller according to the instant description.

DETAILED DESCRIPTION OF AN EXEMPLARY EMBODIMENT

Figure 1:
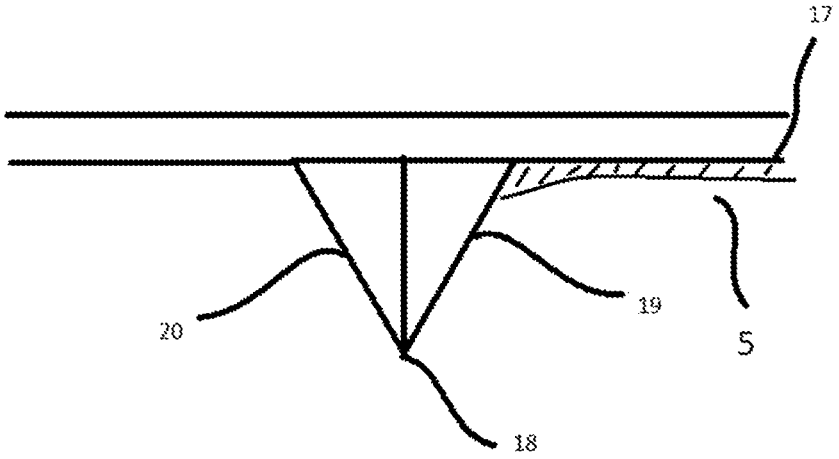
FIG. 1 shows a schematic diagram of a first embodiment of the drip edge according to the disclosure.

FIG. 1 shows schematically the structure of the device having a two-component drip edge, which is mounted on the underside of a surface (17) aligned at a right angle to the gravitational force. The two-component drip edge is formed by a first flank (19) and a second flank (20), which meet in the edge (18), which is aligned in the direction of the gravitational force. The first flank (19) is disposed on the side of the surface, which is wetted with liquid (5). The first flank (19) is made of a material having approximately the same surface tension as the wetting liquid (5) or having a greater surface tension than the liquid (5). The second flank (20) is formed by a material having a lower surface tension than the material of which the first flank (19) is formed. The surface tension of the material used for the second flank (20) is advantageously lower than the surface tension of the liquid with which the device comes in contact. The liquid (5) spreads on the surface (17) and the first flank (19). As soon as the liquid front has reached the edge (18), a drop forms due to the reversal of the direction of the surface opposite the direction of the gravitational force and also due to the repulsive behavior of the second flank (20) with respect to the liquid dripping off the edge of the drip edge of the surface.

Figure 2:
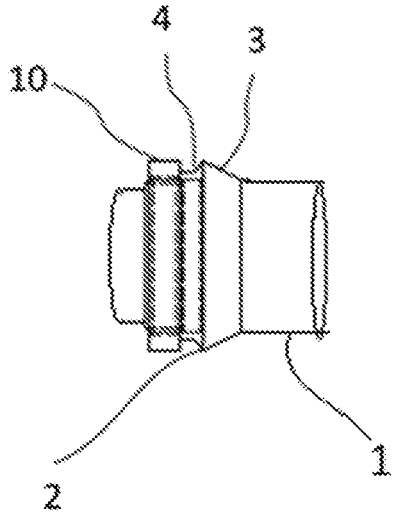
FIG. 2 shows a schematic diagram of a second embodiment of a drip edge disposed in a circular pattern around a cylinder.

FIG. 2 shows schematically a longitudinal section through a device for controlled diversion of liquids with a rotationally symmetrical surface in the form of a cylinder (1). A two-component drip edge formed by an edge designed to be concentric with the surface and directed outward and having a first flank and a second flank leading away from the edge is disposed on the surface, which is designed in the form of a cylinder, wherein the first flank is connected to the liquid-wettable surface and has a higher surface tension than the second flank. The two flanks are each in the form of a truncated cone. In the embodiment shown here, the second flank (4) is secured by the clamping ring (10).

Figure 3:
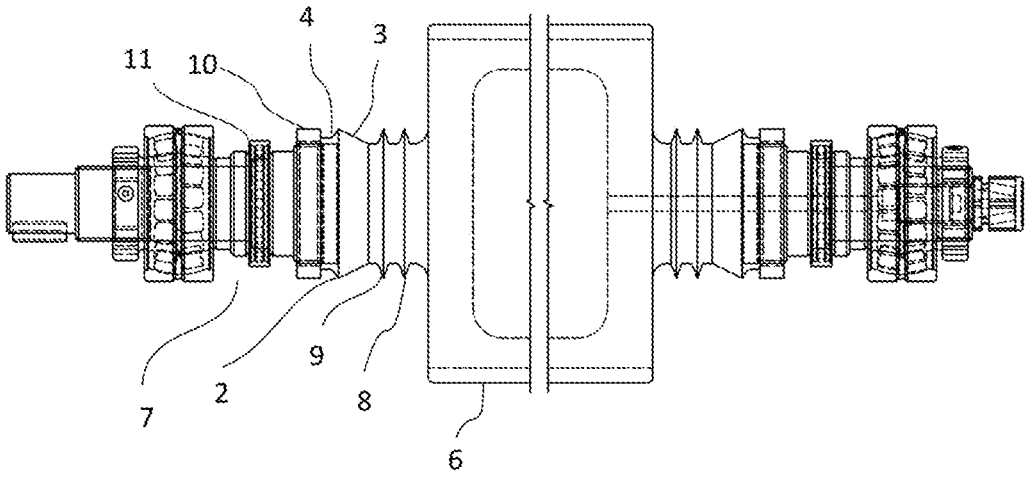
FIG. 3 shows a schematic diagram of a roller according to the disclosure.

FIG. 3 shows a roller according to the disclosure, such as that which can be used as a pan roller in a printing machine, for example. The transfer cylinder, which is immersed into the ink during operation, has a connecting part (7) on each end. The pan roller is rotated at a rotational speed of 15 revolutions per minute, for example, during operation. The ink then not only wets the jacket of the cylinder but also migrates onto the surface of the connecting parts (7) during operation. Starting from the transfer cylinder in the direction of the end of the connecting part, a first and a second single-component drip edge (8, 9) are initially disposed advantageously on the connecting part. These may be formed from the material of the connecting part itself, for example, they may be made of steel or iron. These single-component drip edges (8, 9) have a height of 5 mm and, at the surface of the connecting part, a width of approximately 4 mm. To improve the drip behavior, the angle should be selected to be as acute as possible; to avoid cut injuries in cleaning, a minimal angle is advisable. The angle formed by the two flanks of the pre-drip edge may be 40°, for example. Since the roller rotates during operation, complete blockage of the liquid or, when using the roller in a printing machine, complete blockage of the ink with respect to the bearings, is not ensured. For this reason, a two-component drip edge according to the invention is disposed downstream from these single-component pre-drip edges.

The first flank of the drip edge is formed from the material of the connecting part (7), namely steel in this case. The two flanks of the two-component drip edge in this case form an angle of 97°, with the first flank (3) advantageously being designed to be shallower than the second flank (4) in relation to the axis of the connecting part. The second flank (4) consists of a Teflon® (polytetrafluoroethylene) ring mounted directly on the first flank (3) and secured by the clamping ring (10). The roller may be installed in a printing machine, for example, with the bearings (11).

Figure 4:
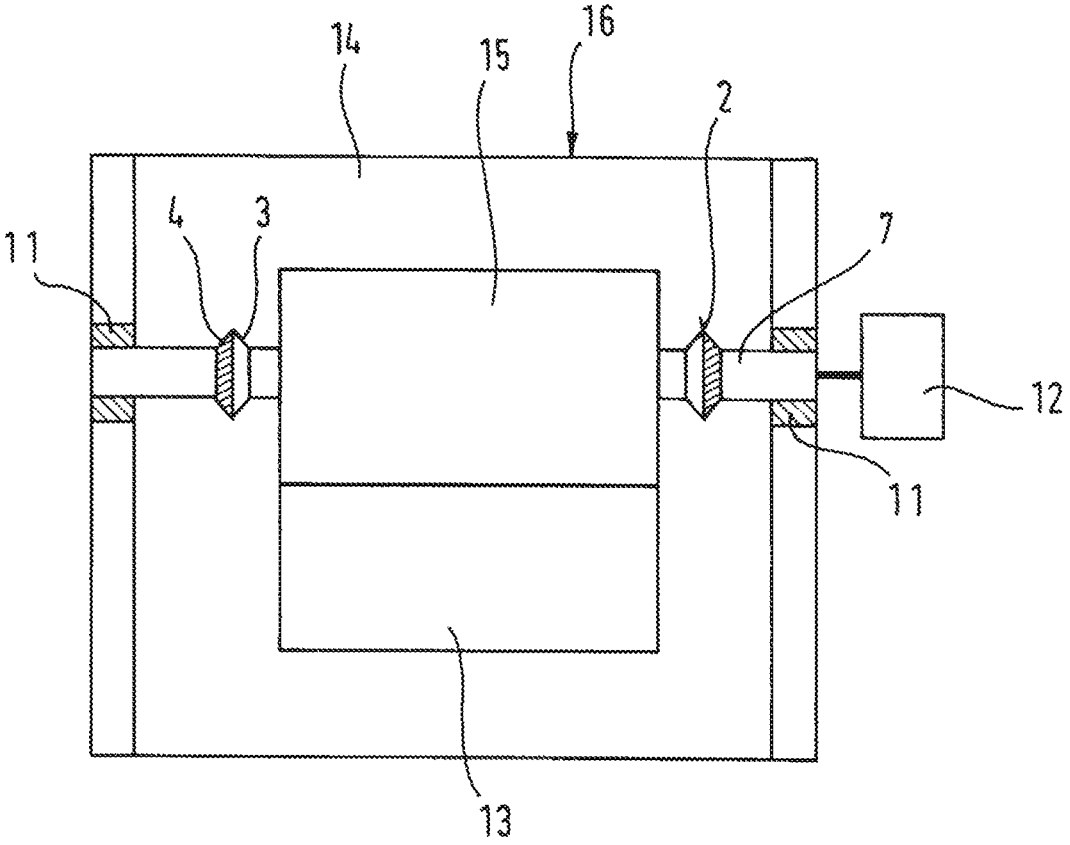
FIG. 4 shows schematically the use of a roller according to the disclosure in a printing machine.

FIG. 4 shows schematically the use of the roller according to the disclosure in a printing machine in conjunction with the pan roller (15) described in relation to FIG. 3. Individual elements of the diagram in FIG. 3 have been omitted with regard to a clearer illustration. The pan roller (15) is partially immersed in an immersion bath (14), from which it picks up the ink and transfers it to the printing roller (13).

The pan roller (15) is secured in the printing machine (16) by means of the connecting parts (7) and bearings (11) and connected to the rotary motor (12). Due to the disposition of the drip edges, the ink drips off above the immersion bath and cannot leak into the bearings and the motor. A printing machine according to the invention therefore requires less maintenance.

LIST OF REFERENCE NUMERALS cyclinder surface (1)
edge (2)

first flank (3)
second flank (4)
liquid (5)
transfer cylinder (6)
connecting parts (7)
single-component pre-drip edge (8)
single-component pre-drip edge (9)
clamping ring (10)
bearing (11)
rotary motor (12)
printing roller (13)
immersion bath (14)
pan roller (15)
printing machine (16)
wettable surface (17)
edge (18)
first flank (19)
second flank (20)

The invention claimed is:

1. A device for controlled diversion of liquids from a surface that can be wetted with a liquid, comprising the surface that can be wetted with liquid and a two-component drip edge attached to the surface, the two-component drip edge formed by an edge aligned in the direction of gravitational force and a first flank and a second flank meeting in and leading away from the edge, characterized in that the first flank is connected to the surface that can be wetted with liquid and has a higher surface tension than the second flank.

2. The device according to claim 1, wherein the first flank is made of iron, polyamide, polyethylene terephthalate, polymethyl methacrylate, polyethylene, polyvinyl chloride, polyoxymethylene, polystyrene or steel.

3. The device according to claim 1, wherein the second flank is made of polypropylene, paraffin wax, epoxy resin or polytetrafluoroethylene.

4. The device according to claim 1, wherein the first flank is made of steel and the second flank is made of polytetrafluoroethylene.

5. The device according to claim 1, wherein the first flank and the second flank meet in the edge to form an angle between 20° and 120°.

6. The device according to claim 1, characterized in that the two-component drip edge has a height of 4-8 mm.

7. The device according to claim 1, characterized in that the two-component drip edge has a height of 5 mm.

8. A device for controlled diversion of liquids from a rotationally symmetrical surface that can be wetted with liquid, comprising the rotationally symmetrical surface and a two-component drip edge connected to the rotationally symmetrical surface and formed by an edge, which edge is disposed concentrically with the rotationally symmetrical surface and is directed outward, and a first flank and a second flank meeting in and leading away from the edge, wherein the first flank is connected to the surface that can be wetted with liquid and has a higher surface tension than the second flank.

9. The device according to claim 8, characterized in that the surface is designed in the form of a cylinder.

10. A pan roller for transferring a liquid, comprising a transfer cylinder having two connecting pieces for fastening the pan roller in bearings, characterized in that the connecting pieces each have a surface wetted with liquid during use and at least one two-component drip edge for controlled dripping of the liquid to be transferred, wherein the at least one two-component drip edge is formed by an edge, which edge is disposed concentrically with the transfer cylinder and is directed outward, and a first flank and a second flank meeting in and leading away from the edge, wherein the first flank is connected to the surface that can be wetted with liquid and has a higher surface tension than the second flank, and wherein the second flank faces the bearing and the first flank faces the transfer cylinder.

11. The pan roller according to claim 10, characterized in that at least one single component pre-drip edge is disposed between the two-component drip edge and the transfer cylinder.

12. The pan roller according to claim 11, characterized in that the at least one single component pre-drip edge has a height of 4-8 mm.

13. The pan roller according to claim 11, characterized in that the at least one single component pre-drip edge has a height of 5 mm.

14. The pan roller according to claim 11, characterized in that the at least one single component pre-drip edge has two flanks forming an angle of 20-80°.

15. A printing machine having at least one pan roller according to claim 10.

* * * * *